US011072926B2

(12) United States Patent
Hall et al.

(10) Patent No.: US 11,072,926 B2
(45) Date of Patent: Jul. 27, 2021

(54) OVERHEAD STORAGE SYSTEM

(71) Applicant: Hall Labs LLC, Provo, UT (US)

(72) Inventors: David R Hall, Provo, UT (US); Andrew Priddis, Mapleton, UT (US); Benjamin Jensen, Orem, UT (US); Scott Skousen, Cedar Hills, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/524,900

(22) Filed: Jul. 29, 2019

(65) Prior Publication Data

US 2021/0032863 A1 Feb. 4, 2021

(51) Int. Cl.
*E04B 9/00* (2006.01)
*E04B 9/06* (2006.01)

(52) U.S. Cl.
CPC ..... *E04B 9/006* (2013.01); *E04B 9/003* (2013.01); *E04B 9/06* (2013.01)

(58) Field of Classification Search
CPC ..... E04B 5/43; E04B 5/02; A47B 9/20; A47B 81/00; A47B 51/00; A47B 46/005; A47B 47/0091; A47B 2200/0052; A47B 2220/13
See application file for complete search history.

(56) References Cited

U.S. PATENT DOCUMENTS

| | | | | |
|---|---|---|---|---|
| 2,499,791 A * | 3/1950 | Spencer | A47B 51/00 312/247 |
| 5,535,852 A * | 7/1996 | Bishop | B66B 9/00 187/336 |
| 7,407,150 B1 * | 8/2008 | Bellantoni | B66D 1/26 254/285 |
| 7,575,098 B2 * | 8/2009 | Hartley | B66B 9/00 187/261 |
| 9,420,881 B2 * | 8/2016 | Reid | A47B 51/00 |

* cited by examiner

*Primary Examiner* — Patrick J Maestri

(57) ABSTRACT

An overhead storage system is disclosed. The storage system includes an overhead frame that supports a ceiling for a room, at least one storage box, and a roof or floor for a second room above the first. Attached to the frame is at least one raise/lower mechanism which raises and lowers a storage box. The storage box(es) fit within the frame when raised and are accessible when lowered. Each storage box has a bottom wall that includes a ceiling surface for the room and a structure with at least one storage surface. The raise lower mechanism(s) is a winch driven pulley system that winds up and lets out at least one line.

20 Claims, 11 Drawing Sheets

OVERHEAD STORAGE SYSTEM

CROSS-REFERENCE TO RELATED APPLICATIONS

This application is a continuation-in-part of U.S. application Ser. No. 16/364,000, filed Mar. 25, 2019. The entire disclosure of this prior application is incorporated by reference herein.

TECHNICAL FIELD

This invention relates to storage systems, and more specifically to overhead storage systems.

BACKGROUND

Ceilings in buildings—such as homes, apartments, and offices—provide the top-most surface(s) of a room and have numerous purposes, which can include visual appeal, structural strength, thermodynamic control, and dust isolation.

Above the bottom surface(s) of a ceiling is generally a floor and/or roof surface(s).

Between the bottom surface(s) of the ceiling and the floor/roof surface(s) there is generally a load bearing structure that supports the ceiling and floor/roof surfaces. Some designs—such as a truss system—use sparsely arranged structural members that result in significant open space between the ceiling and the floor/roof. This space can be used for additional purposed such as insulating between the ceiling and floor/roof surfaces; placement of utility systems such as plumbing, ducting, and wiring; and/or providing in-ceiling storage.

Accessible storage is often desirable for those using a room. While above ceiling storage is possible, accessing it is generally cumbersome and preference often seems to be given to storage and storage systems which are below the ceiling. This can result in underuse of open spaces within loadbearing support structures between ceiling and floor/roof surfaces.

SUMMARY

In a first aspect, the disclosure provides an overhead storage system. The system includes an overhead frame and a storage box that fits within the frame. The storage box includes a bottom wall with a lower surface that provides a ceiling surface for a room and a structure with at least one loadbearing storage surface for the storage box. The system includes at least one raise/lower mechanism connected between the frame and the storage box. The at least one raise/lower mechanism includes a winch configured to wind up and let out a line and a pulley set with at least one pulley mounted to the frame or the storage box. The line is attached to the winch and attached to either the frame or the storage box. The winch, the line, and the at least one pulley of the at least one raise/lower mechanism cooperate to lower the storage box from a storage position to an access position and to raise the storage box from the access position to the storage position.

In a second aspect, the disclosure provides for the overhead storage system to be integrated into a modular building system.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
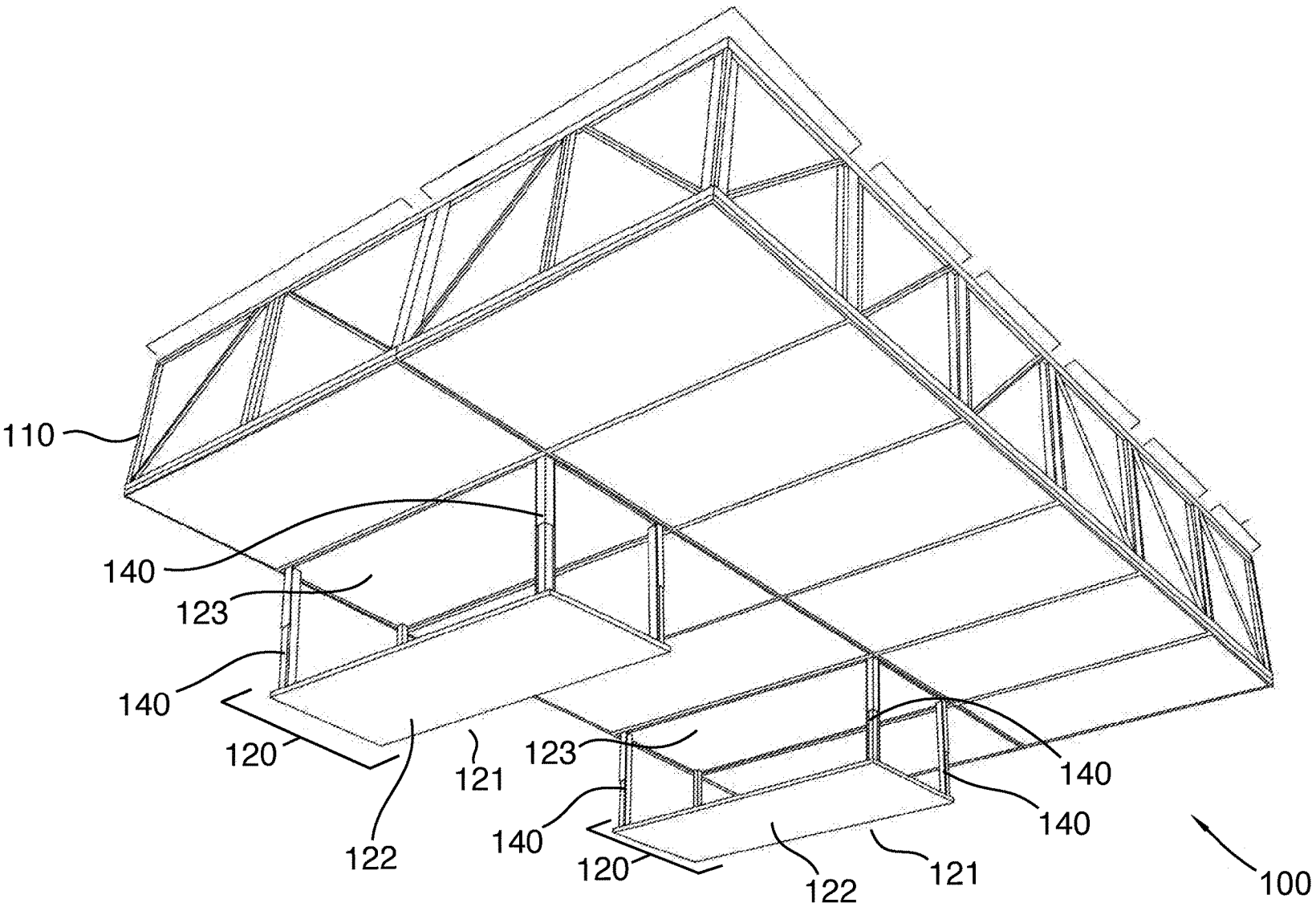
FIG. 1 is a perspective view of one embodiment of the invention.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "output force" is meant to refer to the force exerted by a physical tool, mechanical device, or machine system on a body.

As used herein, "input force" is meant to refer to the force exerted on a physical tool, mechanical device, or machine system by a body.

As used herein, "mechanical advantage" is meant to refer to the force amplification of a physical tool, mechanical device, or machine system. This amplification is given as a number created by dividing the output force by the input force. Thus, a physical system that has an out put force of 4 Newtons (N) from an input force of 1 N would have a mechanical advantage of 4.

As used herein, "ideal" may be added to "mechanical advantage" to form the phrase "ideal mechanical advantage". This phrase is meant to refer to the case where the physical tool, mechanical device, or machine has the same output power as input power. It is typically considered theoretical and is generally determined by using a simplified model of the tool, device, or machine. Such a model may neglect the effects of factors such as friction, deflection, and stretching, which factors may result in input power being transferred to heat or stored in the system instead of being perfectly transferred to the output.

As used herein, "degrees of freedom" refers to 6 types of motion available to a physical object. Three of the types of motion are linear directions which are perpendicular to each other. An example of this could be directions "x", "y", and "z" where each has the following definitions: x is forward/backward, y is right/left, and z is up/down. The three other types of motion are rotational wherein the object can rotate perpendicularly relative to any of the linear directions. In the x, y, and z example above, each of x, y, and z can each become an axis around which the object can rotate. Together, these 6 degrees of freedom define the motion of an object in physical space. As used herein, a "degree of freedom" is the individual consideration of any of these linear or rotational degrees of freedom. Additionally, degree or degrees of freedom can refer to the count of unrestrained degrees of freedom an object has after external factors limit one or more degree of freedom.

When used herein as a unit of measure for length, a "rod" is 16.5 feet. As used herein, a rectangular plot of land that measures 40 rods by 4 rods is a "perfect acre". As used herein, a "square furlong" is 10 perfect acre plots of land placed side-by-side to form a square plot of land. As used herein, there are 640 acres in a square mile. As used herein, a "mile square" is a square that measures 1 mile in length and 1 mile in width.

As used herein, "smart phone" refers to any of a class of mobile personal electronic devices used to wirelessly communicate which primarily originated as cellular phones and grew to include such things as SMS text messaging, internet browsing, and mobile software applications generally referred to as "apps" or "mobile apps". As used herein, "smart phone" also included devices that are similar to those mentioned above in software capability, but without cellular service capability.

Now referring to FIG. 1, a preferred embodiment of an overhead storage system 100 is depicted. The overhead storage system 100 comprises an overhead frame 110, multiple storage boxes 120 that each fit within the overhead frame 110, and a raise/lower mechanism and raise/lower guide 140 per storage box connected between the frame 110 and each storage box 120 to raise and lower said storage box 120 in a substantially vertical direction relative to overhead frame 110. Each storage box 120 comprises a bottom wall 121 with a lower surface 122 that provides a ceiling for a room and a loadbearing storage surface 123 above the lower surface 122. In one embodiment, the overhead frame is configured to be part of a loadbearing structure. In one embodiment, the room is part of a residential space. In an alternative embodiment, the room is part of a communal space and can be used as a stage, including a rostrum or other performance platform.

Preferably, the frame 110 is made of stainless steel. The steel is preferably of rectangular tube, flat bar, and angles. More preferably, the rectangular tube has approximately 1/16" thickness and is of 3 shapes: (1) 3/4" square, (2) 1.5"×3/4", and (3) 1.5" square; the flat bar is 1.5"×1/4"; and there is no angle. In one preferred embodiment, the 3/4" square tubes run along the perimeter edges of the frame, the flat bar generally runs along the perimeter faces as diagonals, and the 1.5" tubes are generally used for the remainder of the frame. In an alternative preferred embodiment, the flat bar is replaced by 3/4" tubes. In an alternative preferred embodiment, the horizontal 3/4" tubes are replaced by either shape of 1.5" tube.

In a preferred embodiment, the frame is fabricated as follows: the pieces of the frame are cut to size, jigged together, then robotically laser welded together. The robotic laser welding provides the finish of the weld. In the finished product, the rectangular tubes are arranged horizontally and vertically in a rectangular box shape that is 2 rods long, 1/2 a rod wide, and 1/4 of a rod tall. The vertical tubes are generally spaced 1/4 of a rod apart. The flat bars and some rectangular tubes are arranged diagonally between about half of the junctions where vertical and horizontal tubes meet, generally with 2 or more diagonals meeting at any junction. The diagonals are positioned on planes perpendicular to one of the length, width, or height and in such a way as to not hinder the desired motion of any storage box relative to the frame.

In alternative embodiments, the frame may be comprised of sub-frame sections with a system that holds the sub-frame sections in position relative to each other. In one preferred embodiment, the system is a cable or rope system. Preferably, the cable system uses stainless steel cable that is run through the rectangular tubes comprising the frame. The cable is tensioned and the force from that tension is transferred to the sub-frame sections in a manner which secures the sections in position relative to each other. More preferably, the cable is run through contiguous rectangular tubes. More preferably, a cable is run through multiple colinear rectangular tubes.

In alternative embodiments, there are guides or a guide system that fit within the rectangular tubes to help line up the sub-frame sections. These guides may also provide structural support within the frame. More preferably, the cable runs through openings within the guides.

In alternative embodiments, multiple frames and/or overhead storage systems may be secured together by means of a cable or rope system. In a preferred embodiment, guides may also be used in conjunction with the cable or rope system to secure multiple frames and/or overhead storage systems together. Securing multiple frames and/or overhead storage systems together may include the use of additional components which are part of a building component such as vertical components which support an overhead storage system above another overhead storage system.

Preferably, significant parts of storage box 120 are made of stainless steel or aluminum alloys. Preferably the steel is rectangular tube and c-channel. Preferably, the aluminum is angle and/or sheet metal. Preferably, the storage box uses at least one of the same sizes of stainless rectangular tube as the frame. Preferably, the c-channel measures ¾" wide and has ½" long legs. Preferably, the stainless and aluminum pieces are jigged and robotically laser welded together and/or bolted together. Preferably, the storage box is essentially the same size as the space between the frame pieces. More preferably, the height of the storage box is approximately ¼ of a rod tall (approximately ¼ of a rod −9" or +9"). More preferably, the storage box has a rectangular horizontal perimeter that is nearly ¼ of a rod long on one side and either nearly ¼ or nearly ½ of a rod long on the other side (approximately 0" to 6" shorter than the described fractional rod lengths).

Preferably, a raise/lower mechanism and 2 raise/lower guides 140 are positioned on a nearly ¼ of a rod side of storage box 120. Preferably, on the opposing side of rectangularly shaped storage box 120 are another raise mechanism and 2 raise/lower guides 140. Preferably, the two remaining sides of storage box 120, which are either nearly ¼ or nearly ½ a rod long, are generally open for easy access of the storage space (i.e. without diagonal flat bar, c-channel, or insulating panels). In one preferred embodiment, two raise/lower mechanisms may be combined or share components such as sharing one motor and/or shaft.

Preferably, the bottom wall and its lower surface include a combination of aesthetic and utility features, of which there are many suitable options. The specific application will determine which combination of features is preferred. Selection of desirable features include: lifespan, rigidity, utility, aesthetics. (1) durability—selection of the bottom wall and lower surface will generally include consideration for how long the surface will remain in a usable condition given expected use and environment; (2) structural characteristics—static and dynamic loading, desired stiffness, cushion, and other mechanical specifications and requirements will vary across use cases and are generally a significant factor in selecting the bottom wall and lower surface; (3) aesthetic appeal—psychological factors are generally a part of the selection process.

Figure 1A:
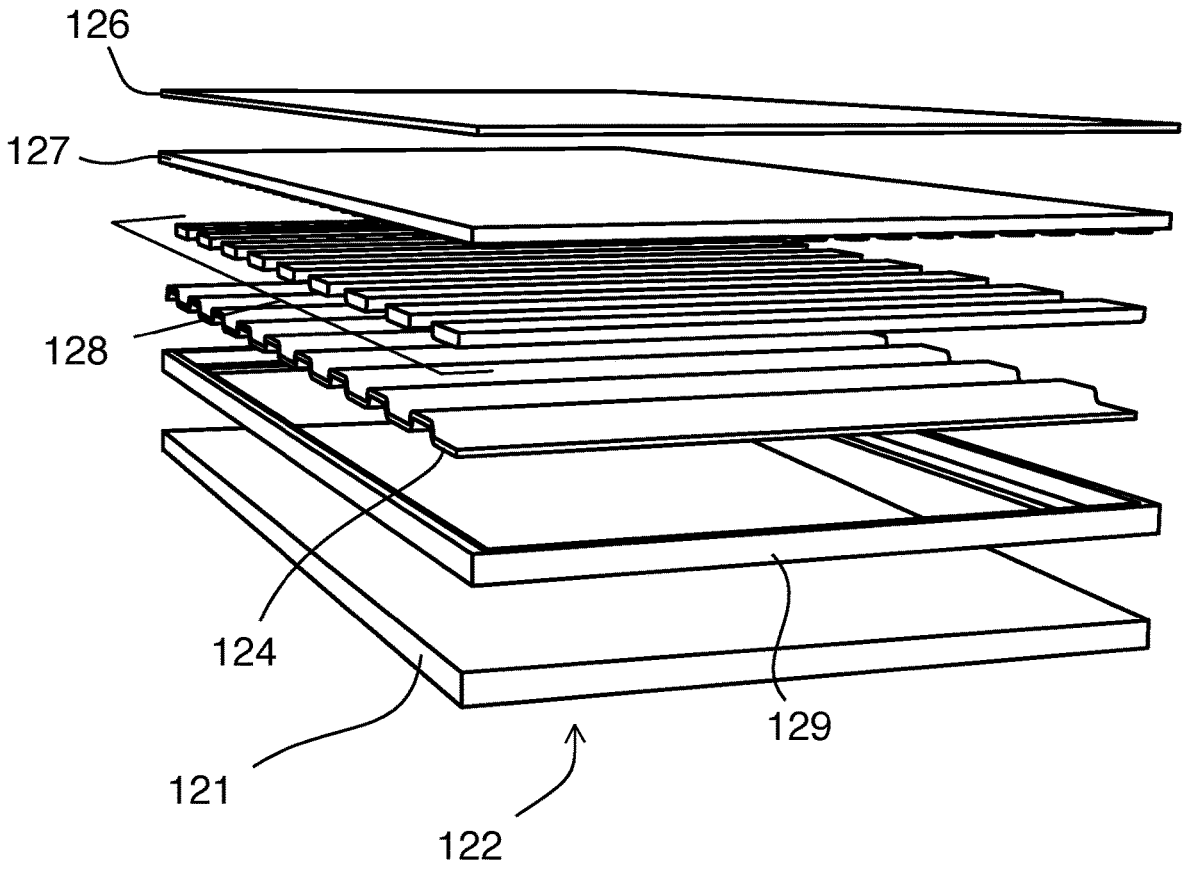
FIG. 1*a* is an exploded view of the bottom wall of the embodiment depicted in FIG. 1.

FIG. 1A depicts an exploded view of one embodiment of a bottom wall. In one preferred embodiment, the bottom wall includes a bottom layer 121. Bottom layer 121 includes the lower surface 122.

Preferably, the bottom layer is selected from typical ceiling materials such as wood, plastic, drywall, gypsum, acoustic or ceiling tiles, metal ceiling tiles, wallpaper, fabric, stucco, tile, linoleum, vinyl, rubber, concrete, or stone. In one preferred embodiment, the bottom layer is a rigid plastic. In another preferred embodiment, the bottom layer is gypsum. In another preferred embodiment, the bottom layer is paint on a rigid surface such as wood or drywall.

In a preferred embodiment, the bottom wall has layers in addition to the bottom layer. Additional layers may include a top layer 126, structural layer 124, and other miscellaneous layers 127 such as a heating and/or cooling layer, a rubber layer, an insulating layer, and a woody or organic layer such as Masonite. Preferably, the structural layer is comprised of wood, metal, or plastic. In one preferred embodiment, the structural layer comprises sheet metal. More preferably, the sheet metal is shaped rather than flat. Even more preferably, the sheet metal is shaped in such a way that it has improved structural characteristics. In the most preferred embodiment, the structural layer is corrugated stainless steel. In one embodiment, an insulating layer 128 such as Styrofoam may be recessed within cavities in a corrugated metal layer.

In a preferred embodiment, the bottom wall is substantially encased on its sides by a sidewall 129. More preferably, the side wall helps hold the various layers of the bottom wall in the desired position. Preferably, the sidewall is of sheet metal, flat bar, or angle. In one preferred embodiment, the side wall is comprised of angle with one leg of the angle forming the sidewall and the other leg positioned parallel to the bottom wall to form a shelf to support layers in the bottom wall. Preferably, the components of the side wall are welded together. Preferably, the side wall is bolted or welded to the storage box and/or the corrugated metal. More preferably, the metal is stainless steel. Alternatively, the side wall can be made from aluminum. In one preferred embodiment, the bottom layer hides the side wall when viewed directly below the bottom wall. In another preferred embodiment, the side wall is visible from below the bottom wall.

In one preferred embodiment, when a storage box is in its raised position, its bottom wall and/or its side wall contact the frame.

In alternative embodiments, the overhead storage system can be configured with various sizes, shapes, and structures for an overhead frame, a storage box, a bottom wall, a lower surface, and/or a loadbearing storage surface. Alternative embodiments could also have the overhead storage system configured with a different number of raise/lower mechanisms to raise or lower a storage box relative to a frame. Alternatively, the overhead storage system can be configured with different quantities of storage boxes.

Figure 2:
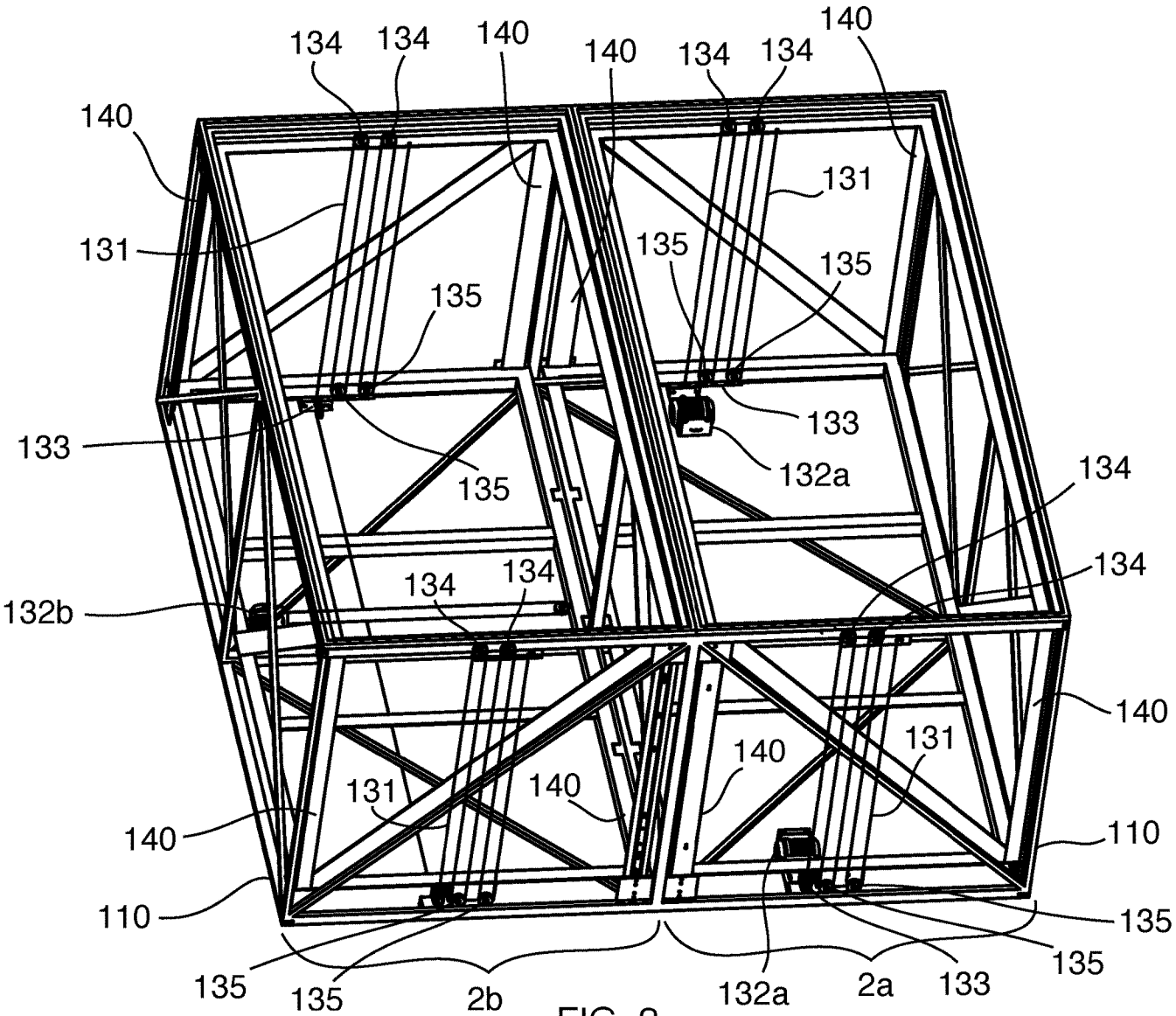
FIG. 2 is a perspective view showing frames and raise/lower mechanisms.

FIG. 2 depicts a close-up view of one embodiment of a raise/lower mechanism 130*a*. Each raise/lower mechanism 130*a* is comprised of a line 131, a winch 132*a* attached to frame 110 and configured to wind up and let out the line 131, and multiple pulleys 133, 134, & 135. The line 131 has a location at or near one end that is directly attached to or translationally fixed relative to the frame 110. The other end of the line 131 is attached to the winch 132*a*. Pulleys 133 and 134 are directly attached or translationally fixed relative to the frame 110. Pulleys 135 are directly attached or translationally fixed relative to the storage box 120. The line 131 and pulleys 134 and 135 are configured to provide an ideal mechanical advantage of 4 as shown in the figure.

FIG. 2 also depicts a close-up view of an alternative embodiment of a raise/lower mechanism 130*b*. Raise/lower mechanism 130*b* is comprised of two lines 131, a winch 132*b* attached to frame 110 and configured to wind up and let out both lines 131, and multiple pulleys 133, 134, & 135. Each line 131 has a location at or near one end that is directly attached to or translationally fixed relative to the frame 110. The other end of each line 131 is attached to the winch 132*b*. Pulleys 133 and 134 are directly attached or translationally fixed relative to the frame 110. Pulleys 135 are directly attached or translationally fixed relative to the storage box 120. The lines 131 and pulleys 134 and 135 are configured to provide an ideal mechanical advantage of 4 as shown in the figure.

Preferably, the winch is selected to take the loading necessary to raise and lower the storage box. Preferably, the winch is selected and positioned to maximize the storage space above the bottom wall. In one preferred embodiment, winch 132*a* is the MyLifter® Basic Lifter which is described in various patents, including:

U.S. Pat. No. 9,399,566 Grooved Drum and Associated Roller for Motorized Lifting Device
U.S. Pat. No. 9,567,195 Grooved Drum and Associated Passive Guide for Motorized Lifting Device
U.S. Pat. No. 9,598,269 Motorized Lifting Device with Accurate Weight Measuring Capability
U.S. Pat. No. 9,624,076 Synchronized Motorized Lifting Devices for Lifting Shared Loads
U.S. Pat. No. 9,673,360 Locking Mechanism for Motorized Lifting Device
U.S. Pat. No. 9,860,361 Wirelessly Controlled Inflator
U.S. Pat. No. 9,873,600 Motorized Lifting Device with Isolated Logistics and Power Electronics
U.S. Pat. No. 9,908,754 Intelligent Motorized Lifting Device
U.S. Pat. No. 10,036,119 Thimble Assembly for a Cord
U.S. Pat. No. 9,963,328 Motorized Lifting Device Conveying Power and/or Data
U.S. Pat. No. 9,988,250 Improved Drum for Motorized Lifting/Pulling Device
U.S. Pat. No. 9,988,118 Load-Level Suspended Hanger
U.S. Pat. No. 9,975,745 Compact Motorized Lifting Device
U.S. Pat. No. 9,988,251 Motorized Lifting Device with Mounting Flanges
U.S. Pat. No. 9,988,248 Accurate Position Tracking for Motorized Lifting Device
U.S. Pat. No. 10,112,809 Reliable Spooling For A Motorized Lifting/Pulling Device Preferably, the winch is controlled via wireless connection between itself and a portable electronic device. More preferably, the electronic device is a smart phone with software controls to raise/lower the one or more storage boxes. Preferably, when used in conjunction with other winches to lift a storage box, the winches are coordinated so they raise/lower the storage box together, more preferably evenly.

Most preferably, the raise/lower mechanisms are programmable. As one example, the mechanism can be programmed to raise and lower at predetermined times. As another example, the mechanisms can be programmed to raise and lower in sync with other mechanisms so that two or more storage boxes are lifted or lowered at the same time.

In alternative embodiments a raise/lower mechanism could be configured for a different ideal mechanical advantage; with a different quantity of pulleys, lines, or winches; with the winch attached to the storage box 120; and/or with the line attached to the storage box 120.

FIG. 2 also shows the raise/lower guide 140 which helps guide the storage box as it raises and lowers. Preferably when connecting two components which are otherwise unconnected, the guide substantially limits degrees of freedom of the two components relative to each other so they may only move translationally in one direction. Preferably, two or more guides are configured to provide motion that is parallel to each other. More preferably, each raise/lower mechanism is accompanied by 2 guides. Another way to say this is that a guide connects two components in a way that limits translational motion to 1 degree of freedom and multiple guides work together to limit translational motion to 1 degree of freedom.

Preferably, a guide is comprised of components that nest within each other and which slide relative to each other to provide one direction of translational motion. Preferably, the nested components do not directly contact each other, but are separated by a system which comprises ball bearings and reduces loads that would hinder the translational motion. More preferably, a guide is a drawer slide which is sized to provide at least approximately ¼ of a rod of translational motion.

Figure 3C:
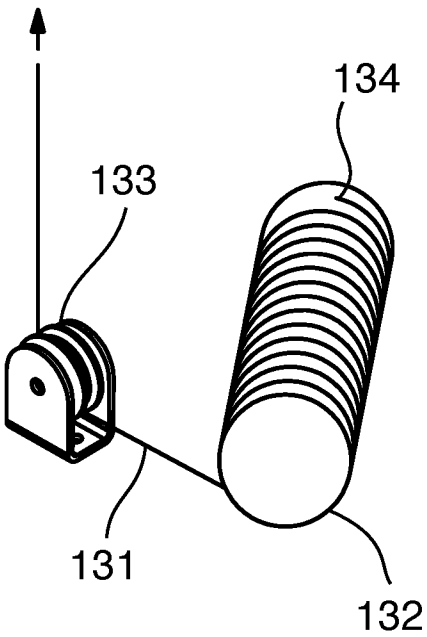
FIG. 3C depicts an embodiment wherein the pulley is configured to change angles at a different angle than shown in either FIG. 3A or FIG. 3B.
Figure 3B:
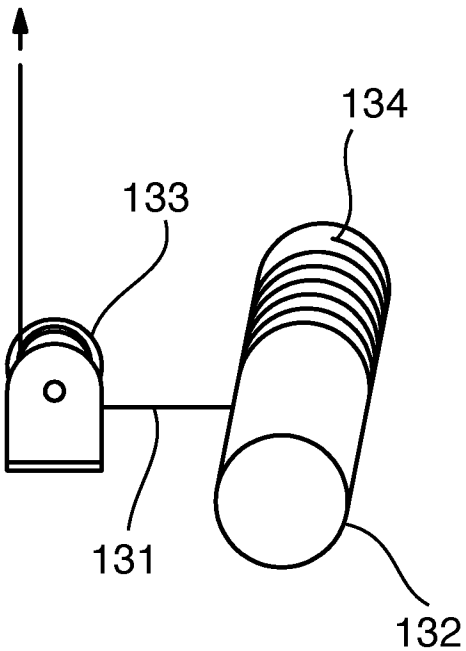
FIG. 3B depicts an embodiment wherein the pulley is configured to change angles at a different angle than shown in FIG. 3A.
Figure 3A:
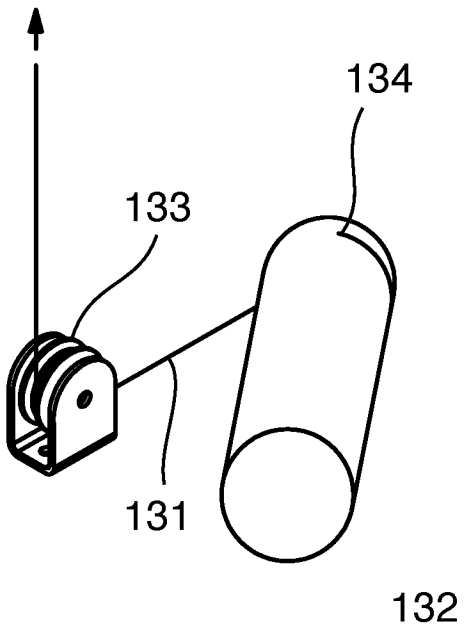
FIG. 3A depicts an embodiment wherein the pulley is configured to change angles.

FIGS. 3A, 3B, and 3C each depict a close-up view of a winch 132, pulley 133, and a portion of line 131 going from the winch 132 to the pulley 133 in an embodiment where pulley 133 is configured to change angles relative to winch 132 based on the location line 131 exits winch 132. Each view depicts location 134 where line 131 attaches to the spooling portion of winch 132. Each view depicts pulley 133 at a different angle relative to winch 132. Adjusting the angle of pulley 133 relative to winch 132 is a way to reduce the wear experienced by line 131 and pulley 133 as well as reducing power loss of the raise/lower mechanism. Alternative embodiments may be configured without an angling pulley; this selection could be based on the characteristics of the line 131, the winch 132, the pulley 133, and/or loading.

FIGS. 4A, 4B, 4C and 4D each depict various embodiments of a loadbearing storage surface. Multiple loadbearing storage surfaces and types of load bearing storage surfaces can be used with a single storage box.

Figure 4A:
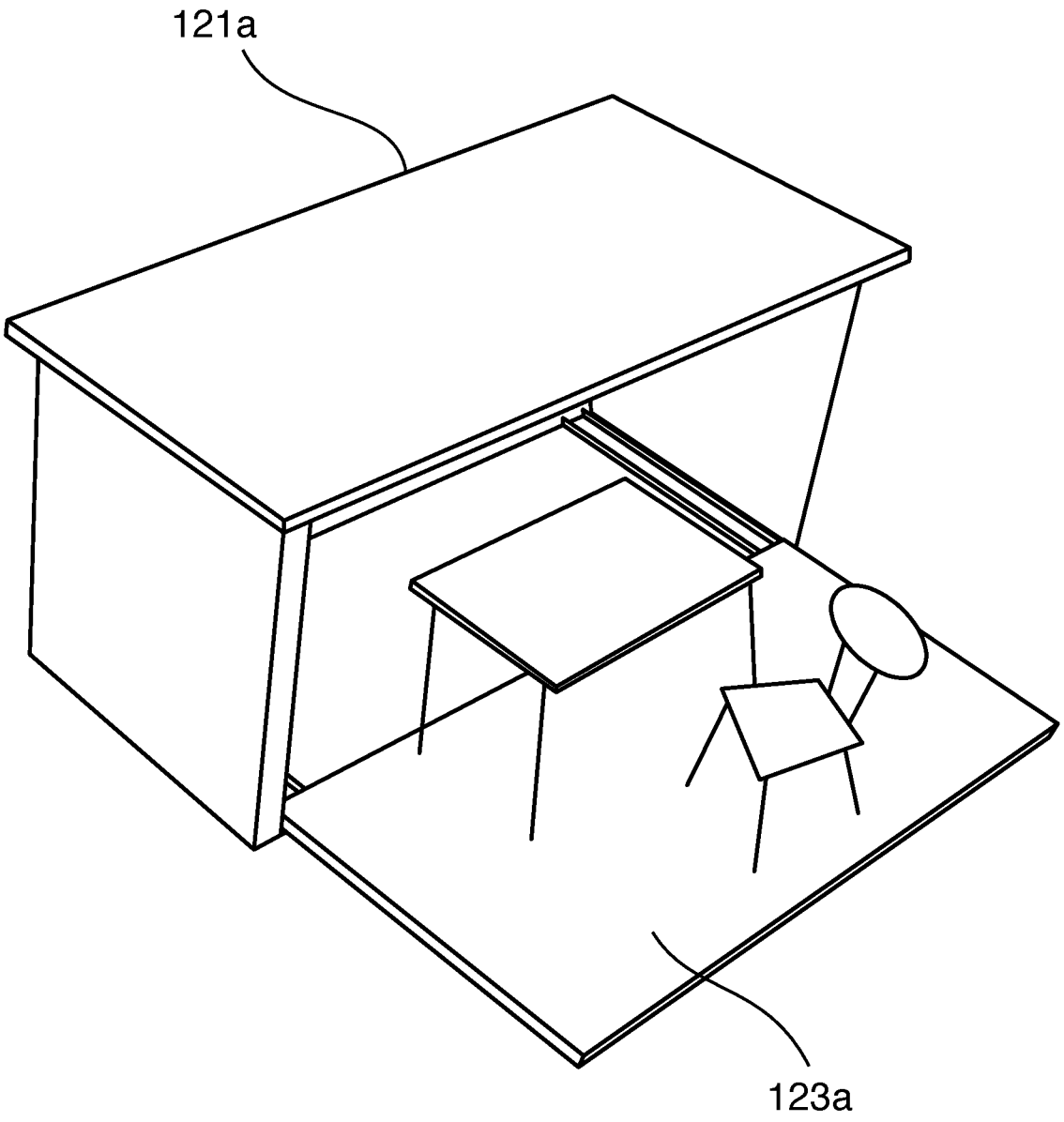
FIG. 4A is a perspective view of one embodiment of the invention.

FIG. 4A depicts one embodiment of loadbearing storage surface 123*a* wherein the surface is a floor. Preferably, storage surface 123*a* is similar in size and design to the bottom wall 121*a* with adjustments made to allow for the storage surface to be raised to the level of an adjacent lower surface on a bottom wall when that bottom wall is in its lowered position or an adjacent ceiling surface. In one embodiment, the storage surface 123*a* is configured to slide relative to the storage box and/or bottom wall. In a preferred embodiment, the storage surface slides horizontally relative to the storage box and/or bottom wall.

Figure 4B:
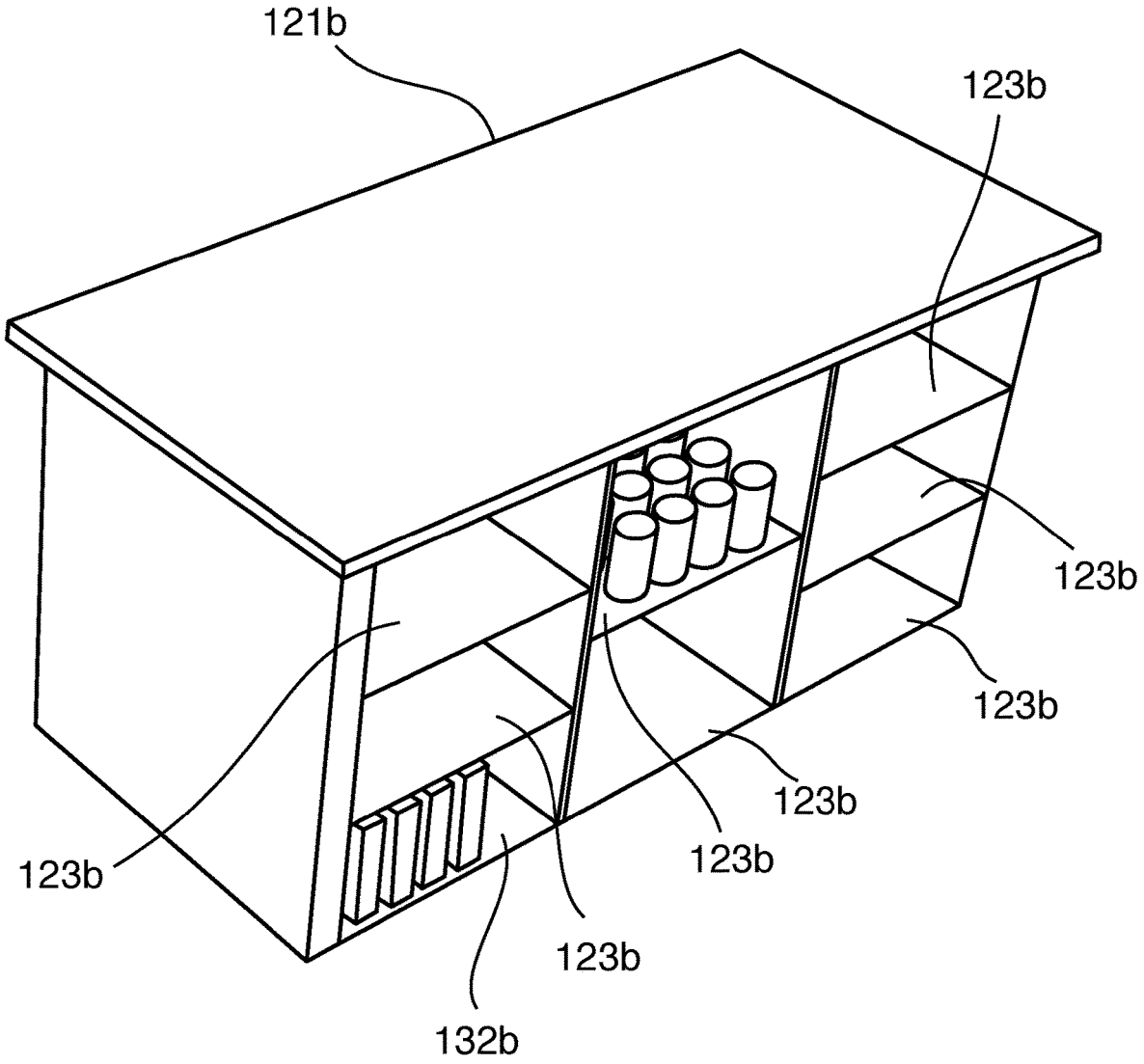
FIG. 4B is a perspective view of one embodiment of the invention.

FIG. 4B depicts one embodiment of loadbearing storage surfaces 123*b* wherein the surface is a shelf or set of shelves. In one embodiment, multiple shelves comprise the storage surfaces above the bottom wall 121*b*. In an alternative embodiment, a storage box has one or more shelves in addition to at least one other type of storage surface.

Figure 4C:
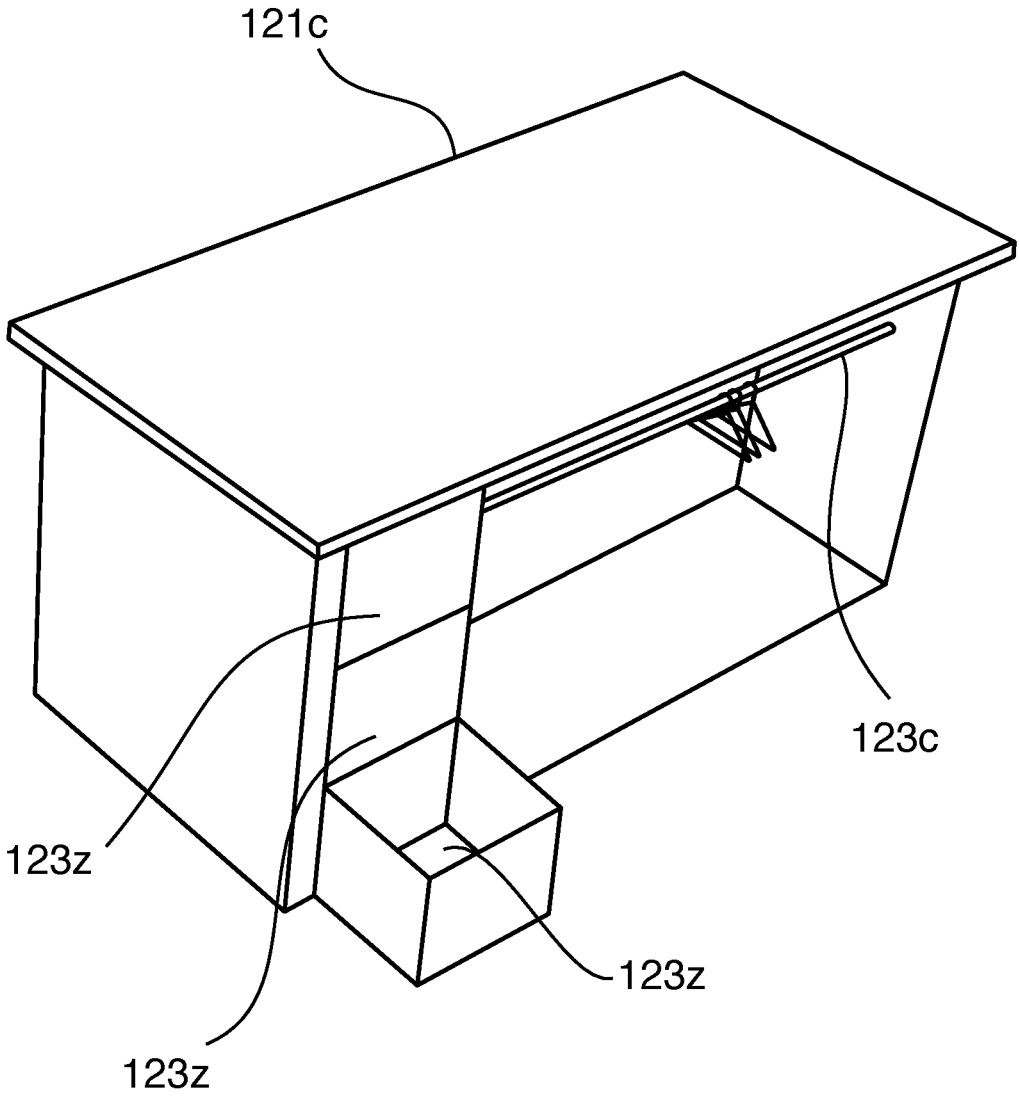
FIG. 4C is a perspective view of one embodiment of the invention.

FIG. 4C depicts one embodiment of loadbearing storage surface 123*c* above bottom wall 121*c* wherein the surface is a bar or post for hanging items such as hangers, clothing such as coats, and kitchen items such as pans. FIG. 4C also depicts one embodiment of storage surface 123*z* wherein the surface is a drawer or box.

Figure 4D:
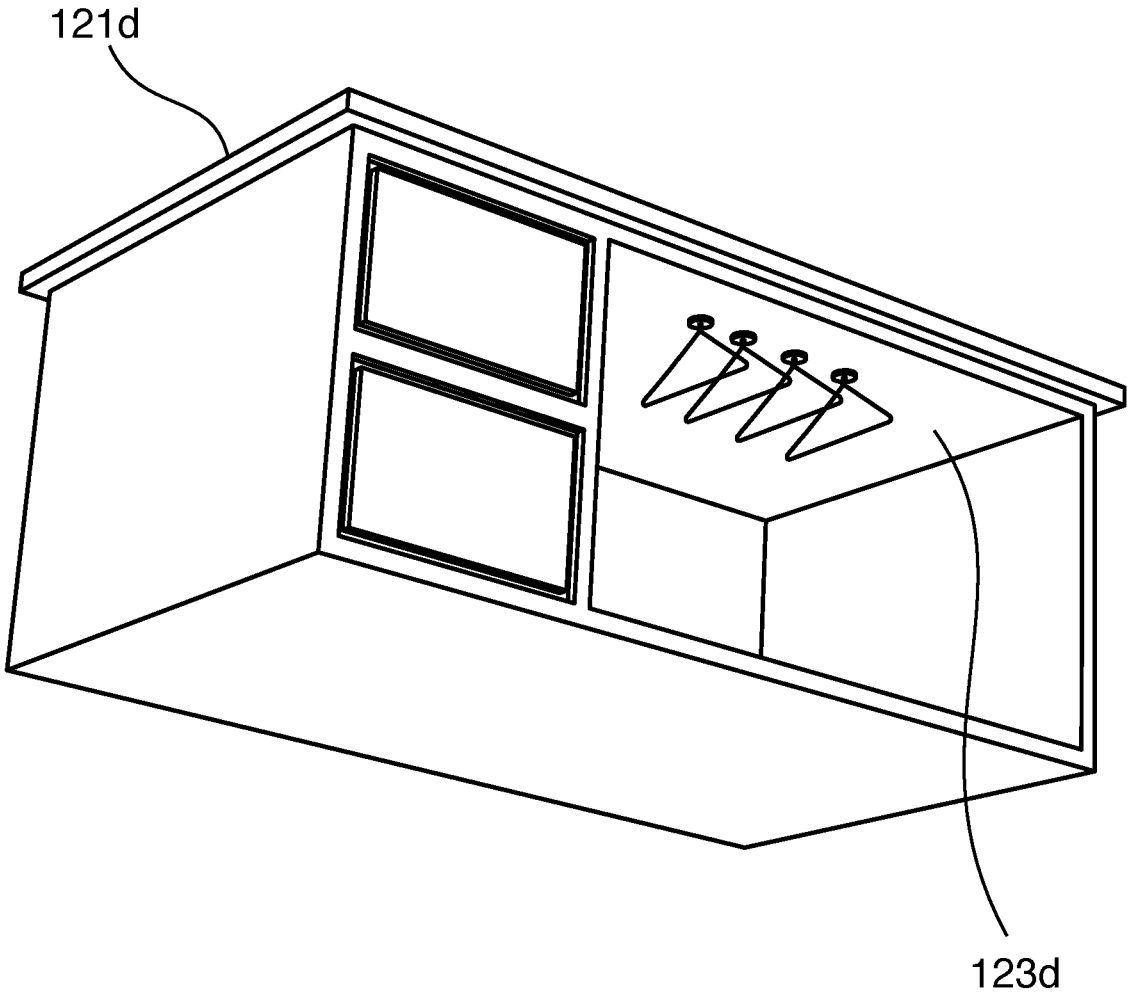
FIG. 4D is a perspective view of one embodiment of the invention.

FIG. 4D depicts one embodiment of loadbearing storage surface 123*d* above bottom wall 121*d* wherein the surface is configured to magnetically secure items in the storage box. In one preferred embodiment, the storage surface is made of or combined with a magnetic material to which items with magnets are magnetically attached. In an alternative embodiment, the storage surface is magnetic or can be induced to be magnetic.

Figure 5:
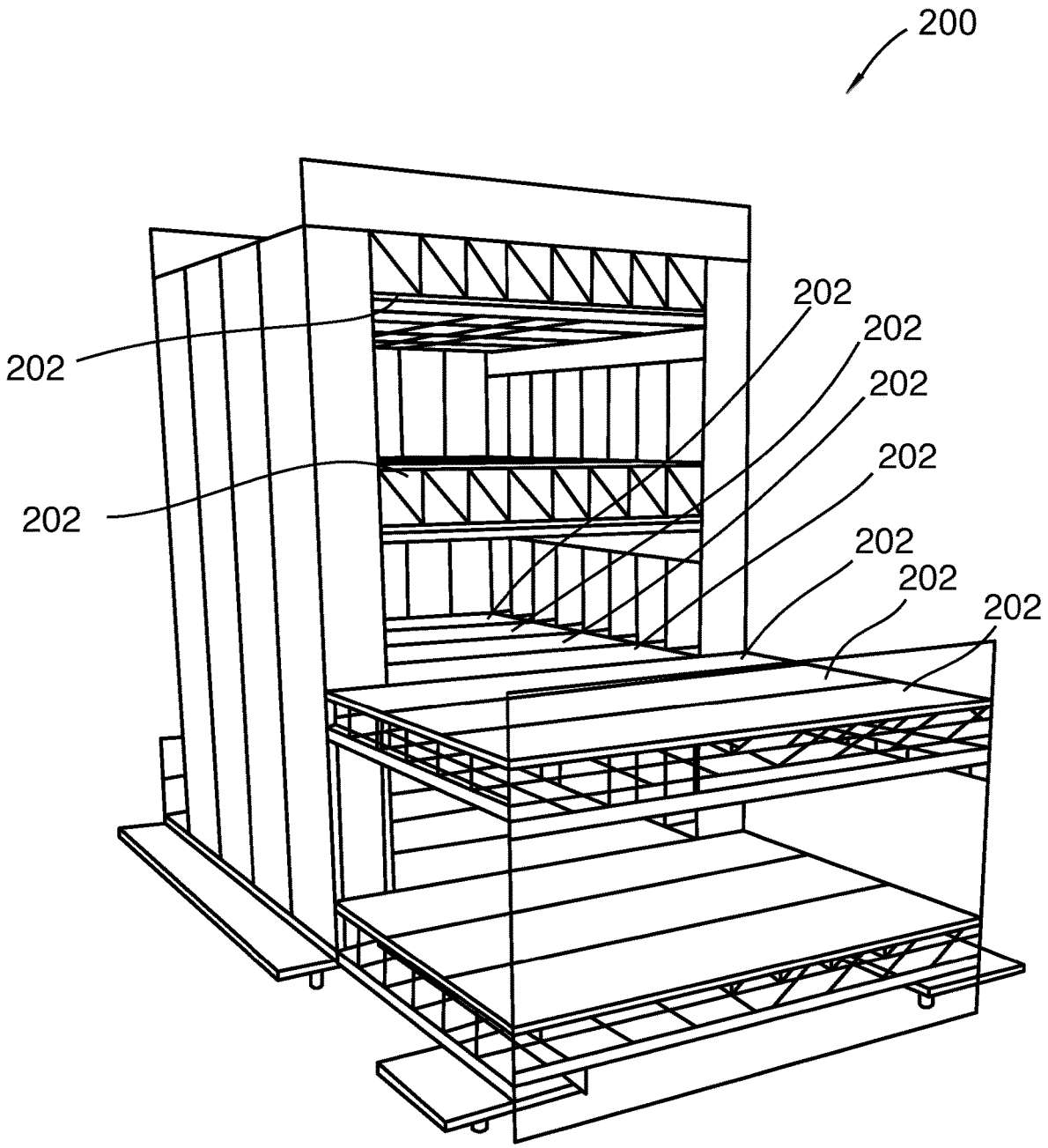
FIG. 5 is a perspective view of the overhead storage system integrated into a modular building system.

FIG. 5 depicts an overhead storage system 202 integrated into a multi-story building 200. Preferably, multiple overhead storage systems 202 and/or buildings 200 can be combined to make a building complex that fills a one-perfect-acre lot 300. In a preferred embodiment, the components of the overhead storage system are designed based on rod-based dimensions. Preferably, the overhead storage system is a quarter rod in height. Preferably, the overhead storage system is half a rod wide. Preferably, the overhead storage system is two rods long. Preferably, the building component has the same length and width dimensions as the overhead storage system. Preferably, a perfect acre can be filled by the placement of multiple buildings in a 2×20 pattern.

Figure 6:
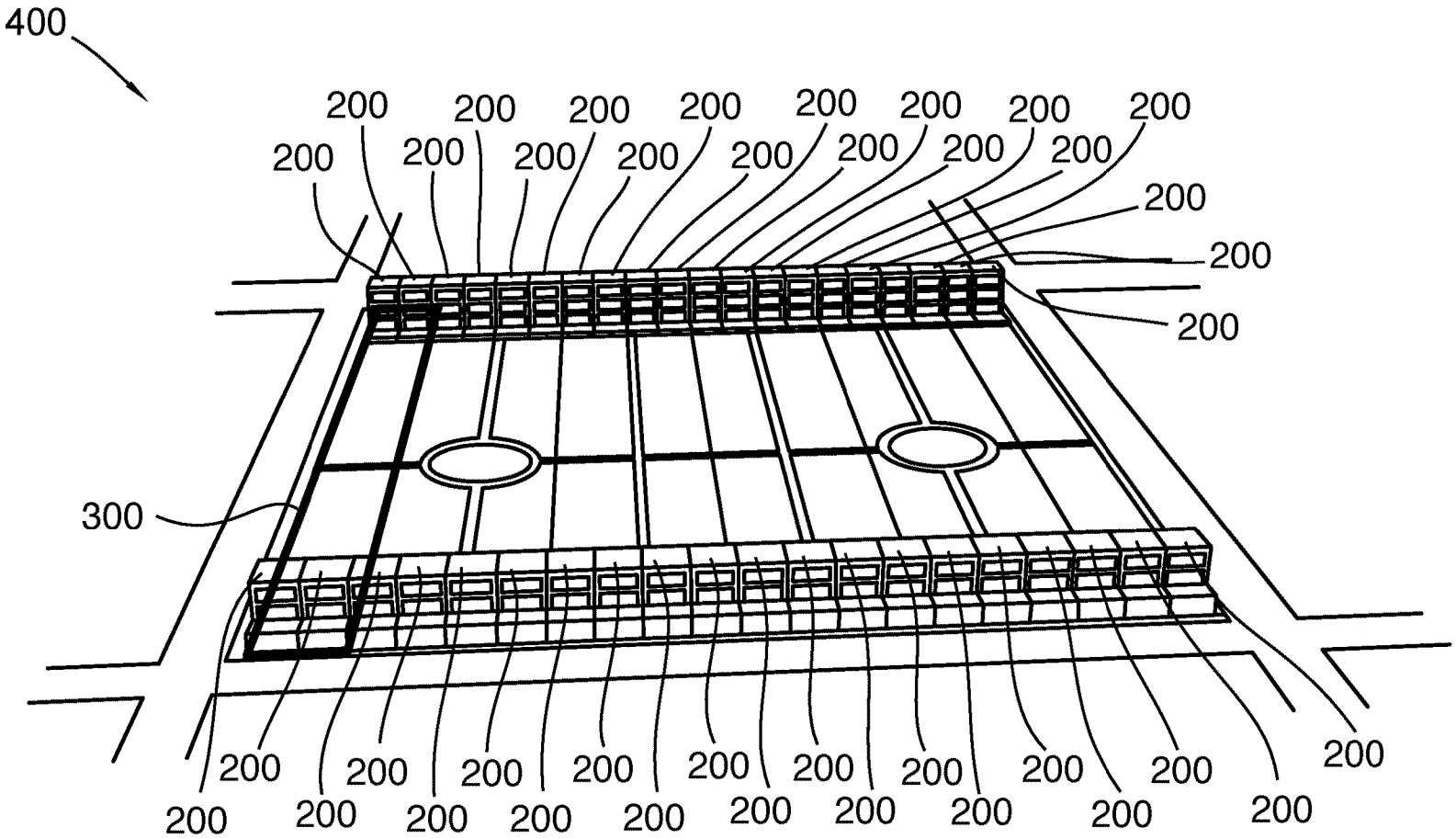
FIG. 6 is a perspective view of the overhead storage system integrated into a modular building system.

FIG. 6 depicts one embodiment of multi-story building 200 with other multi-story buildings 200 on a square furlong plan 400 divided into 10 1-acre lots 300.

Figure 7:
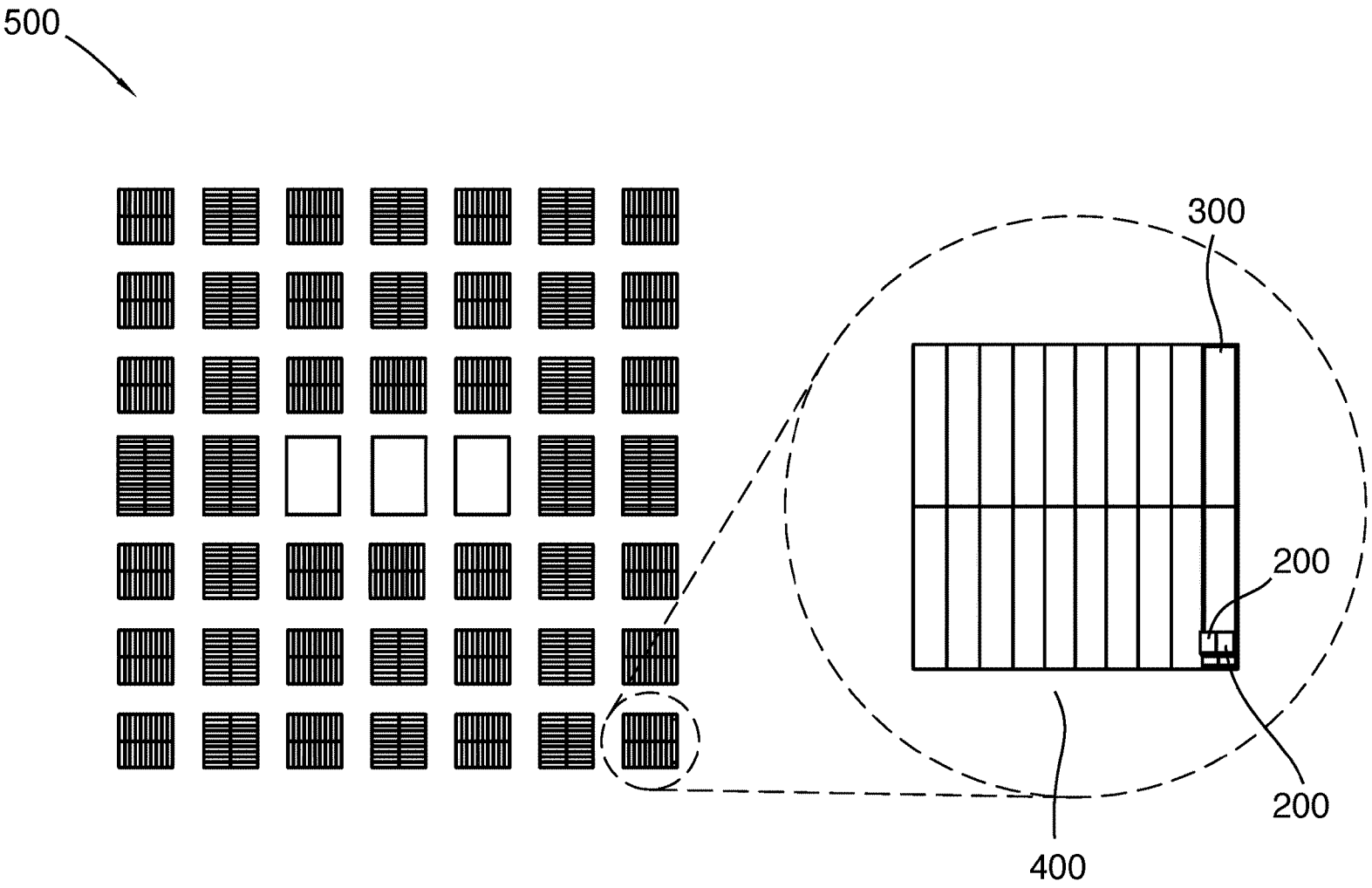
FIG. 7 is a top view of the overhead storage system integrated into a community built from the modular building system.

FIG. 7 depicts one embodiment of a square furlong lot 400 integrated into a 1-mile-square plan 500.

Alternatively, the system described herein can be modified and incorporated into other ceiling overhead storage applications.

All patents and published patent applications referred to herein are incorporated herein by reference. The invention has been described with reference to various specific and preferred embodiments and techniques. Nevertheless, it is understood that many variations and modifications may be made while remaining within the spirit and scope of the invention.

What is claimed is:

1. An overhead storage system comprising:

an overhead frame configured to support a ceiling of a first room, to support a floor above the first room, and to provide a space therebetween;

a storage box that fits within the frame and comprises a bottom wall with a lower surface that provides a ceiling surface for the first room and a structure with at least one loadbearing storage surface for the storage box;

at least one raise/lower mechanism connected between the frame and the storage box to raise and lower the storage box relative to the frame, wherein the at least one raise/lower mechanism comprises a line with a fixed portion attached to either the frame or the storage box;

a winch mounted to either the frame or the storage box and configured to wind up and let out the line to raise and lower the storage box;

a pulley set comprising a first pulley mounted to whichever of the frame and the storage box the winch is not mounted to;

wherein the line is attached to the winch; and wherein the winch, the line, and the first pulley of the at least one raise/lower mechanism cooperate to lower the storage box from a storage position to an access position and to raise the storage box from the access position to the storage position;

wherein the storage position is configured to be located in the space between the ceiling and the floor above the ceiling; and wherein the line passes through the first pulley on its run from the winch to either (a) a second pulley of the pulley set mounted to whichever of the frame or storage box the winch is attached to or (b) where the fixed portion of the line is attached to whichever of the frame or storage box the winch is mounted to, thereby providing a mechanical advantage.

2. The invention of claim 1, wherein the loadbearing storage surface is a floor of the storage box.

3. The invention of claim 1, wherein the loadbearing storage surface is a drawer, a hanger, or a sub-box, wherein the sub-box comprises a horizontal bottom wall and at least one vertical wall above the horizontal bottom wall.

4. The invention of claim 1, wherein the storage box is configured to incorporate and/or receive at least one of the following: a storage system, an item of furniture, an appliance, and clothing.

5. The invention of claim 1, wherein the frame is configured to be part of a loadbearing structure of a building comprising the first room.

6. The invention of claim 5, wherein the building is a residential building.

7. The invention of claim 1, wherein the floor above the first room is for a second room above the first room.

8. The invention of claim 1, wherein the winch is mounted to the frame.

9. The invention of claim 1, wherein the winch is mounted to the storage box.

10. The invention of claim 1, further comprising a second raise/lower mechanism connected between the frame and the storage box, wherein the second raise/lower mechanism comprises a second line with a fixed portion attached to either the frame or the storage box;

a second winch mounted to either the frame or the storage box and configured to wind up and let out the second line to raise and lower the storage box;

a second pulley set comprising a second-first pulley mounted to whichever of the frame and the storage box the second winch is not mounted to;

wherein the second line is attached to the second winch; and wherein the second line is attached to the second winch; and wherein the second winch, the second line, and the second pulley set of the second raise/lower mechanism cooperate with the at least one raise/lower mechanism to lower the storage box from the storage position to an access position and to raise the storage box from the access position to the storage position; and wherein the second line passes through the second-first pulley on its run from the second winch to either (a) a second-second pulley of the second pulley set mounted to whichever of the frame or storage box the second winch is attached to or (b) where the fixed portion of the second line is attached to whichever of the frame or storage box the second winch is mounted to, thereby providing an additional mechanical advantage.

11. The invention of claim 1, further comprising a second line with a fixed portion attached either to the frame or the storage box and a second pulley set comprised of a second-first pulley mounted to whichever of the frame and the storage box the winch is not mounted to, wherein the second line passes through the second-first pulley on its run from the winch to either (a) a second-second pulley of the second pulley set mounted to whichever of the frame or storage box the winch is attached to or (b) where the fixed portion of the second line is attached to whichever of the frame or storage box the winch is mounted to, thereby providing an additional mechanical advantage, and wherein the first line and first pulley set are connected between the frame and one side of the storage box, the second line and second pulley set are mounted between the frame and an other side of the storage box, and the winch is configured to wind up and let out the second line in addition to the first line.

12. The invention of claim 1, wherein the pulley set further comprises a directional pulley mounted to whichever of the frame and storage box the winch is mounted to which facilitates the line changing direction relative to the winch and wherein the directional pulley is configured such that its orientation can change relative to the winch to adjust for variations in an angle at which the line approaches the pulley from the winch.

13. The invention of claim 1, wherein the pulley set is configured for force and/or movement mechanical advantage with an ideal mechanical advantage of 4.

14. The invention of claim 1, wherein the pulley set comprises 5 pulleys attached to one or both of the frame and/or storage box; and wherein the at least one raise/lower mechanism comprises 2 pulleys which are attached to the storage box, an end of the line is attached to the winch, and the other end of the line and 2 pulleys are attached to the frame, thereby providing an additional mechanical advantage.

15. The invention of claim 1, further comprising one or more guides configured to facilitate substantially linear motion of the box relative to the frame.

16. The invention of claim 1, further comprising additional storage boxes configured to be raised and lowered.

17. The invention of claim 1, wherein the in-ceiling storage system is integrated into a modular building system.

18. An in-ceiling storage system comprising:

an overhead frame configured to support a ceiling of a first room, to support a floor above the first room, and to provide a space therebetween;

a storage box that fits within the frame and comprises a bottom wall with a lower surface that provides a ceiling surface for the first room and a structure with at least one loadbearing storage surface for the storage box;

at least one raise/lower mechanism connected between the frame and the storage box to raise and lower the storage box relative to the frame, wherein the at least one raise/lower mechanism comprises a first line and a second line, each of which have a fixed portion attached to the storage box;

a winch attached to the frame configured to wind up and let out the first line and the second line to raise and lower the storage box;

a first pulley set comprising a first pulley mounted to the storage box and a second pulley mounted to the frame, both on one side of the storage box;

a second pulley set comprising a second-first pulley mounted to the storage box and a second-second pulley mounted to the frame, both on an other side of the storage box;

wherein the first and second lines are attached to the winch; and wherein the winch, the first and second lines, and the first and second pulley set of the raise/lower mechanism cooperate to lower the storage box from a storage position to an access position and to raise the storage box from the access position to the storage position;

wherein the storage position is configured to be located in the space between the ceiling and the floor above the ceiling; and wherein the first line passes through the first pulley then the second pulley on its run from the winch to where the fixed portion of the first line is attached to the storage box, the second line passes through the second-first pulley and then the second-second pulley on its run from the winch to where the fixed portion of the second line is attached to the storage box, thereby providing a mechanical advantage.

19. The invention of claim 18, wherein the overhead storage system is integrated into a modular building system.

20. An in-ceiling storage system comprising:

an overhead frame configured to support a ceiling of a first room, to support a floor above the first room, and to provide a space therebetween;

a storage box that fits within the frame and comprises a bottom wall with a lower surface that provides a ceiling surface for the first room and a structure with at least one loadbearing storage surface for the storage box;

a first raise/lower mechanism connected between the frame and one side of the storage box, a second raise/lower mechanism connected between the frame and an other side of the storage box, wherein each of the first and second raise/lower mechanisms comprise a line with a fixed portion attached to either the frame or the storage box;

a winch attached to the frame configured to wind up and let out the line to raise and lower the storage box;

a directional pulley attached to the frame which is configured to pivot relative to the winch to adjust to variations in the angle at which the line approaches the pulley from the winch;

second and third pulleys attached to the frame;

fourth and fifth pulleys attached to the storage box;

wherein the line is attached to the winch; and wherein the winches, the lines, and the first, second, third, fourth and fifth pulleys of the first and the second raise/lower mechanisms cooperate to lower the storage box from a storage position to an access position and to raise the storage box from the access position to the storage position;

wherein the storage position is configured to be located in the space between the ceiling and the floor above the ceiling; and wherein, in each of the first and second raise/lower mechanisms, the line exits the winch; passes through the directional pulley, then the second pulley, then the fourth pulley, then the third pulley, and then the fifth pulley; and then runs to where the fixed portion of the line is attached to the frame or storage box; thereby providing a mechanical advantage.

* * * * *